United States Patent [19]

Rushmere

[11] Patent Number: 4,798,653

[45] Date of Patent: Jan. 17, 1989

[54] RETENTION AND DRAINAGE AID FOR PAPERMAKING

[75] Inventor: John D. Rushmere, Wilmington, Del.

[73] Assignee: Procomp, Inc., Marietta, Ga.

[21] Appl. No.: 165,634

[22] Filed: Mar. 8, 1988

[51] Int. Cl.[4] ..... D21H 3/58; D21H 3/78

[52] U.S. Cl. ..... 162/168.3; 162/181.6; 162/183

[58] Field of Search ..... 162/168.3, 181.6, 183

[56] References Cited

U.S. PATENT DOCUMENTS

| | | | |
|---|---|---|---|
| 3,007,878 | 11/1961 | Alexander et al. | 252/313 |
| 3,052,595 | 9/1962 | Pye | 162/164 |
| 3,620,978 | 11/1971 | Moore, Jr. | 252/313 |
| 3,719,607 | 3/1973 | Moore, Jr. | 252/313 |
| 3,956,171 | 5/1976 | Moore, Jr. et al. | 252/313 |
| 4,006,495 | 2/1977 | Jones | 2/93 |
| 4,305,762 | 12/1981 | Ostreicher et al. | 162/181 |
| 4,305,781 | 12/1981 | Langley et al. | 162/164 |
| 4,309,247 | 1/1982 | Hou et al. | 162/149 |
| 4,385,961 | 5/1983 | Svending et al. | 162/175 |
| 4,388,150 | 4/1983 | Sunden et al. | 162/175 |
| 4,578,150 | 3/1986 | Hou | 162/164.3 |

FOREIGN PATENT DOCUMENTS

| | | |
|---|---|---|
| 67735 | 1/1985 | Finland . |
| 67736 | 1/1985 | Finland . |
| 8600100 | 1/1986 | Sweden . |
| 8605826 | 10/1986 | Sweden . |
| 1265496 | 3/1972 | United Kingdom . |
| 1387744 | 3/1975 | United Kingdom . |

*Primary Examiner*—Peter Chin

*Attorney, Agent, or Firm*—Luedeka, Hodges & Neely

[57] ABSTRACT

A papermaking stock comprising cellulose fibers in an aqueous medium at a concentration of preferably about 50% by weight of the total solids in the stock including a retention and dewatering aid comprising a two component combination of an anionic polyacrylamide and a cationic colloidal silicia sol. The stock exhibits enhanced resistance to shear forces during the papermaking process. A papermaking process is also described.

10 Claims, No Drawings

RETENTION AND DRAINAGE AID FOR PAPERMAKING

This invention is directed to an aid for use in enhancing the resistance to shear and the retention of fibrous fines and/or particulate fillers in a paper web formed by vacuum felting of a stock on a wire or the like, and enhancing the dewatering of the web in the course of its formation.

Various aids have been proposed heretofore which enhance the retention and/or dewatering characteristics of a paper web. Specifically, U.S. Pat. Nos. 4,578,150 and 4,385,961 disclose the use of a two-component binder system comprising a cationic starch and an anionic colloidal silicic acid sol as a retention aid when combined with cellulose fibers in a stock from which is formed a paper web by vacuum felting on a wire or the like. Finnish Published Specifications Nos. 67,735 and 67,736 refer to cationic polymeric retention agent compounds including cationic starch and polyacrylamide as useful in combination with an anionic silicon compound to improve the reception of a sizing. In Specification No. 67,735, the sizing agent is added in the furnish, whereas in Specification No. 67,736, the sizing is applied after the paper web is formed. These documents do not propose nor suggest enhanced resistance of the stock to shear or dewatering enhancement.

Many other prior publications have suggested different combinations of cationic and anionic substances as useful in papermaking. Most frequently, such combinations are specific as regards their relative proportions as in U.S. Pat. No. 4,578,150, or as regards their sequence of addition to the pulp slurry as in U.S. Pat. No. 4,385,961. They further often are limited, as regards their effectiveness, to specific pulps, e.g. chemical, mechanical, thermomechanical, etc.

In International Publication No. W086/05826 there is disclosed the use of anionic colloidal silica sol together with cationic polyacrylamide as a retention aid in a papermaking stock. This disclosure is diametrically opposite to the combination of the present invention.

The basic mechanism by which the cationic and anionic component aids function is often stated in terms of the components forming agglomerates, either alone or in combination with the cellulose fibers, that result in retention of fiber fines and/or mineral fillers. It is well recognized in the papermaking art that a pulp slurry, i.e. stock, undergoes severe shear stress at various stages in the papermaking process. After digestion, the stock may be beaten or refined in any of the several ways well known in the papermaking industry or it may be subjected to other similar treatments prior to the deposition of the stock onto a papermaking wire or the like for dewatering and web formation. For example, in a typical papermaking process, after digestion (and possibly bleaching), and even after beating and refining steps, the stock is subjected to shear forces associated with mixing and particularly to hydrodynamic shear associated with flow of the stock through such equipment as distribution devices, some of which divide the pulp stream and then recombine the streams at high velocities and in a manner that promotes mixing by means of high turbulence prior to the stock entering the headbox. Each time the stock is caused to flow from one location to another, it encounters shear, as when flowing through a conduit. Such shear is exarcebated by the high flow velocities encountered in the more modern mills where the paper web is formed as speeds in excess of 4000 feet per minute, thereby requiring larger volumes of stock flow which often translates into greater flow velocities and greater hydrodynamic shear. All of these sources of shear tend to diminish or destroy the flocs or agglomerates developed by the added aids.

Shear stress continues to be experienced by the stock, and in fact is more severe in many instances, as it leaves the headbox, flows onto the wire, and is dewatered. Specifically, as the stock is discharged from the headbox through a manifold, thence a slice, onto the moving wire, there are very strong shear forces exerted upon both the liquid and the solids content of the stock. For example, in those papermaking mechanisms which employ slice jets, there is boundary shear between the stream flowing through each jet and the jet walls. The slice lips can be considered as flat plates held parallel to the main direction of flow; as the fluid travels farther along the plate, the shearing forces, due to the region of viscous action, accomplish the retardation of a continually expanding portion of the flow. As the velocity gradient at the boundary surface is reduced, the growth in boundary layer thickness along the plate is paralleled by a steady increase in boundary shear.

The stock on the wire is subjected to still further hydrodynamic, including shear, forces. Paper sheet forming is predominantly a hydrodynamic process which affects all the components of the stock including fibers, fines, and filler. The fibers may exist as relatively mobile individuals or they may be connected to others as part of a network, agglomerate or mat. The motions of the individual fibers follow the fluid motions closely because the inertial force on a single fiber is small compared with the viscous drag on it. However, the response of the fibers to fluid drag may be drastically modified when they are consolidated in a network or fiber mat. Chemical and colloidal forces are recognized to play a significant part in determining whether the fibers assume a network or mat geometry, such being particularly true with respect to fines and fillers. In commercial systems, heretofore, it has been generally conceded that the hydrodynamic forces exert a significant influence upon the sheet formation and that the degree of this influence is in proportion to the geometry of the fibers, fines and fillers in the stock as the stock reaches the wire and the degree to which this geometry is maintained during the sheet forming stage. Examples of the shear forces experienced by a stock during sheet forming include oriented shear due to velocity differences between the flow of stock and the speed of the wire at the instant the stock contacts the wire. Other shear forces arise as a consequence of the several water removal devices associated with the sheet forming including the application of vacuum at table rolls, drainage foils, etc.

These shear forces encountered by the stock tend toward deflocculation or deagglomeration of the fiber-fines-fillers-aids complexes whose intended function is to maintain their identity in order to obtain the desired intended results of filler and fines retention, good dewatering during web formation, etc. with improved, or no substantial loss of strength and like properties in the paper product. In the prior art it is not known precisely what mechanisms take place as respects the complexing of cellulose fibers, fillers and cationic and anionic aids, but in any event, the present inventor has found that the deleterious effects of shear upon the complexes is reduced or substantially eliminated through the use of the aid and process disclosed herein.

It is therefore an object of the present invention to provide a papermaking stock having improved resistance to shear forces that arise in the course of the papermaking process.

It is another object of the invention to provide an improved combination of additives for a papermaking stock.

It is another object of the present invention to provide a papermaking stock having improved drainage and retention properties.

It is another object of the present invention to provide a papermaking stock which exhibits improved resistance to shear forces and improved retention and drainage properties over a substantial range of pH values.

It is another object to provide an improved papermaking process.

Other objects and advantages will be apparent from the disclosures provided herein.

In accordance with the present invention, a papermaking stock comprising cellulose fibers in an aqueous medium at a concentration of preferably at least about 50 percent by weight of the total solids in the stock is provided with a retention and dewatering aid comprising a two-component combination of an anionic polyacrylamide and a cationic colloidal silica sol in advance of the deposition of the stock onto a papermaking wire. The stock so combined has been found to exhibit good dewatering during formation of the paper web on the wire and desirably high retention of fiber fines and fillers in the paper web products under conditions of high shear stress imposed upon the stock.

The present invention has been found to be effective with pulps of both hardwoods or softwoods or combinations thereof. Pulps of the chemical, mechanical (stoneground), semichemical, or thermomechanical types are suitable for treatment in accordance with the present process. In particular, the present invention has been found to provide shear-resistant complexed stocks where there is present in the stock substantial lignosulfates or abietic acid as might be encountered especially in unbleached mechanical pulps or in other pulps due to accumulation of these substances in recirculated white water.

Inorganic fillers such as clays, calcium carbonate, titanium oxide, and/or recycled broke or other cellulosic waste may suitably be incorporated in stocks processed in accordance with the present invention.

The cationic component supplied to the stock is of a colloidal silica sol type such as colloidal silicic acid sol and preferably such a sol which has at least one layer of aluminum atoms on the surface of the siliceous component. A suitable sol is prepared according to the methods such as described in U.S. Pat. Nos. 3,007,878; 3,620,978; 3,719,607 and 3,956,171, each of which is incorporated herein by reference. Such methods involve the addition of an aqueous colloidal silica sol to an aqueous solution of a basic aluminum salt such that the silica surface is coated with a positive aluminum species rendering the sol cationic. This sol is unstable under normal conditions of storage and, therefore, is preferably stabilized with an agent such as phosphate, carbonate, borate, magnesium ion or the like as is known in the art. Surface aluminum to silicon mol ratios in the sol may range from between about 1:2 to about 2:1, and preferably 1:1.25 to 1.25:1 and most preferable 1:1, the latter being desirably more stable.

Particle size of the sol particulates appears to exhibit a lesser effect in determining the efficacy of the sol as used in the present process than certain other properties such as aluminum/silicon mol ratio, etc. Particle sizes of between about 3 and 30 nm can be employed. The smaller size ranges are preferred because of their generally superior performance.

The anionic component of the present invention comprises a polyacrylamide having a molecular weight in excess of 100,000, and preferably between about 5,000,000 and 15,000,000. The anionicity (degree of carboxyl fraction present) of the polyacrylamide may range between about 1 to about 40 percent, but polyacrylamides having an anionicity of less than about 10 percent, when used with the cationic colloidal silica sols, have been found to give the best all-around balance between freeness, dewatering, fines retention, good paper formation and strength, and resistance to shear.

Suitable anionic polyacrylamides may be obtained either by hydrolysis of a preformed polyacrylamide or by coplymerization of acrylamide with acrylic acid. Anionic polyacrylamides and anionic copolymers derived from the copolymerization of acrylamide with methacrylamide also may be employed in the present invention. The polymer products of either of these methods of production appear to be suitable in the practice of the present invention. As noted hereinabove, the lesser degrees of anionicity are preferred for all-around benefits but optimum shear resistance with acceptable accompanying retention and dewatering properties has been found to occur with those polyacrylamides having an anionicity of between about 1 to 10 percent. Suitable anionic polyacrylamides are commercially available from Hitek Polymers, Inc., Louisville, Ky., (Polyhall brand), from Hyperchem, Inc., Tampa, Fla. (Hyperfloc brand), or Hercules, Inc., Wilmington, Del. (Reton brand) as indicated in the following Table A:

TABLE A

| Polymer | Average Molecular Weight Range (MM) | % Carboxyl |
|---|---|---|
| Polyhall 650 | 10 | 5 |
| Polyhall 540 | 10 | 15–20 |
| Polyhall 2J | 10–15 | 2 |
| Polyhall 7J | 10–15 | 7 |
| Polyhall 21J | 10–15 | 21 |
| Polyhall 33J | 10–15 | 33 |
| Polyhall 40J | 10–15 | 40 |
| Polyhall CFN020 | 5 | 5 |
| Polyhall CFN031 | 10 | 12 |
| Hyperfloc AF302 | 10–15 | 2–5 |
| Reten 521 | 15 | 10 |
| Reten 523 | 15 | 30 |

Of these polymers, the Polyhall 650 provides a combination of good dewatering retention, and shear resistance, while minimizing floc size, and therefore is a preferred polymer for use in the present invention. For addition to the stock, the anionic polymer is prepared as a relatively dilute solution containing about 0.15 percent by weight or less.

In the papermaking process, the cationic colloidal silica sol and the anionic polyacrylamide are added sequentially directly to the stock at or briefly before the stock reaches the headbox. Little difference in fines retention or shear resistance is noted when the order of component introduction is alternated between cationic component first or anionic component first although it is generally preferred to add the cationic component first. As noted above, in the practice of the invention, the sol and polymer preferably are preformed as relatively dilute aqueous solutions and added to the dilute stock at or slightly ahead of the headbox in a manner that promotes good distribution, i.e. mixing, of the additive with the stock.

Acceptable dewatering, retention and shear resistance properties of the stock are obtained when the cationic and anionic components are added to the stock in amounts representing between about 0.01 and about 2.0 weight percent for each component, based on the solids content of the treated stock. Preferably, the concentration of each component is between about 0.2 to about 0.5 weight percent.

In the following Examples, which illustrate various aspects of the invention, the cationic component was a cationic colloidal silica sol prepared according to the teachings of U.S. Pat. No. 3,956,171. Specifically, in the production of the sol, conditions are selected to provide a surface aluminum/silicon mol ratio of from about 1:2 to 2:1, preferably about 1:1.25 to 1.25:1. It has been found that a sol having a surface aluminum/silicon mol ratio of 1:1 is most stable under those conditions existing in papermaking, so that sols with the 1:1 mol ratio are most suitable.

The anionic component used in the Examples comprised various anionic polyacrylamides, each of which is commercially available and identified hereinabove. For addition to the papermaking stock, the anionic polyacrylamides were prepared as dilute solutions of 0.15 weight percent or less as noted. Whereas the pH of the stock in the several Examples was chosen to be pH 4 and pH 8, it is to be recognized that the present invention is useful with stocks having a pH in the range of about pH 4 to pH 9.

EXAMPLE 1

DEWATERING OF GROUNDWOOD PULP

Groundwood pulp is characterized by having a high percentage of fines and low dewatering (freeness). For these tests a 0.3 wt. % stock was prepared from 100% stoneground wood (40% poplar, 60% black spruce). To the stock was added 1.5g/l of sodium sulfate decahydrate to provide a specific conductivity of 115mS/cm similar to that of a typical papermaking process. The pH of the stock was adjusted to either pH 4 or pH 8 by means of dilute sodium hydroxide and sulfuric acid solutions and Canadian Standard Freeness Tests were then run to determine drainage in the presence of various amounts of polyacrylamide and cationic sol.

The polyacrylamide used was Polyhall 650 and was added in amounts up to 1.0 wt % (20 lbs./ton) based on the pulp content of the stock. The cationic sol used is described above and was used in amounts up to 1.5 wt. % of the pulp.

In conducting the tests, one liter of stock was first measured into a Britt Dynamic Drainage Jar as described by K. Britt and J. P. Unbehend in Research Report 75, 1/10, 1981, published by Empire State Paper Research Institute (ESPRI), Syracuse, N.Y. 13210. The bottom of the jar had been blocked off to prevent drainage but to maintain mixing conditions similar to those used in subsequent retention and shear force tests described in later examples. The stock was agitated at 800 rpm for 15 seconds and excellent agitation obtained by means of this and the vanes on the side of the jar. The cationic silica sol was next added as dilute solution with 15 seconds allowed for mixing followed by addition of the dilute polyacrylamide solution. After a further 15 seconds of mixing the contents of the jar were transferred to the hold cup of a Canadian Standard Freeness Tester and the freeness measured.

The results of these tests are presented in Table 1 where it may be seen that the polyacrylamide by itself showed no beneficial effect in increasing the drainage of the stock either at pH 4 or pH 8 (Tests 1–3). Addition of papermakers alum to the system produced no beneficial effect at pH 4. At pH 8, lower loadings of alum increased drainage but this benefit was lost as alum loading was increased (Tests 4–7). In contrast to this, use of the cationic sol in increasing amounts produced a steady increase in drainage both at pH 4 and pH 8 (tests 8–12). Significant improvements in drainage were maintained at both pH levels as the polyacrylamide loading was reduced (Tests 13–15).

In Tests 16–20, the polyacrylamide and the cationic sol were increased to very high loadings to demonstrate that further gains in drainage could be obtained and that the system has a broad range of operability.

TABLE 1

DRAINAGE AS A FUNCTION OF SOL AND POLYMER LOADING
100% Stoneground Wood (40% poplar, 60% Black Spruce)
Polyhall 650 Polyacrylamide

| Test No. | % Polymer Loading | % Cationic Sol Loading | % Alum Loading | Freeness, ml pH 4 | Freeness, ml pH 8 |
|---|---|---|---|---|---|
| 1 | — | — | — | 94 | 81 |
| 2 | 0.1 | — | — | 68 | 53 |
| 3 | 0.2 | — | — | 58 | 38 |
| 4 | 0.2 | — | 0.5 | 80 | 150 |
| 5 | 0.2 | — | 1.0 | 75 | 163 |
| 6 | 0.2 | — | 2.0 | 68 | 84 |
| 7 | 0.2 | — | 5.0 | 66 | 82 |
| 8 | 0.2 | 0.25 | — | 74 | 80 |
| 9 | 0.2 | 0.5 | — | 106 | 116 |
| 10 | 0.2 | 0.6 | — | 130 | 134 |
| 11 | 0.2 | 0.75 | — | 190 | 180 |
| 12 | 0.2 | 1.0 | — | 200 | 246 |
| 13 | 0.1 | 1.0 | — | 192 | 205 |
| 14 | 0.05 | 1.0 | — | 160 | 156 |
| 15 | 0.025 | 1.0 | — | 144 | 130 |
| 16 | 0.4 | 1.0 | — | 205 | 265 |
| 17 | 0.6 | 1.0 | — | 220 | 310 |
| 18 | 0.8 | 1.0 | — | 235 | 320 |
| 19 | 1.0 | 1.0 | — | 240 | 330 |
| 20 | 1.0 | 1.5 | — | 335 | 376 |

EXAMPLE 2

DRAINAGE AS A FUNCTION OF POLYMER ANIONICITY

In this series of tests, the freeness resulting from the use of a variety of anionic polyacrylamides together with cationic sol was examined in a similar manner to that described in Example 1. The stock was again 100% stoneground wood (40% poplar, 60% black spruce). It may be seen from the results in Table 2 that all of the cationic sol/polymer combinations show improved drainage but that the changes in anionicity only show significant variations under alkaline conditions.

TABLE 2

DRAINAGE AS A FUNCTION OF POLYMER ANIONICITY
100% Stoneground Wood (40% poplar, 60% Black Spruce)
Various Polyhall Polyacrylamides

| Test No. | Polyhall Polymer Used | Wt. % Polymer Loading | Wt. % Cationic Sol Loading | Freeness, ml pH 4 | Freeness, ml pH 8 |
|---|---|---|---|---|---|
| 1 | — | — | — | 94 | 81 |
| 2 | 2J | 0.1 | 0.3 | — | 72 |
| 3 | 7J | 0.1 | 0.3 | — | 72 |
| 4 | 21J | 0.1 | 0.3 | — | 110 |
| 5 | 33J | 0.1 | 0.3 | — | 160 |
| 6 | 40J | 0.1 | 0.3 | — | 140 |
| 7 | 540 | 0.1 | 0.5 | — | 124 |
| 8 | 2J | 0.1 | 0.5 | — | 100 |
| 9 | 7J | 0.1 | 0.5 | — | 118 |
| 10 | 21J | 0.1 | 0.5 | — | 210 |
| 11 | 33J | 0.1 | 0.5 | — | 245 |
| 12 | 40J | 0.1 | 0.5 | — | 165 |
| 13 | 2J | 0.1 | 1.0 | — | 320 |
| 14 | 7J | 0.1 | 1.0 | — | 350 |
| 15 | 21J | 0.1 | 1.0 | — | 355 |
| 16 | 33J | 0.1 | 1.0 | — | 355 |
| 17 | 40J | 0.1 | 1.0 | — | 320 |
| 18 | 33J | 0.05 | 1.0 | — | 258 |
| 19 | 33J | 0.10 | 1.0 | — | 355 |
| 20 | 33J | 0.15 | 1.0 | — | 415 |
| 21 | 33J | 0.20 | 1.0 | — | 410 |
| 22 | 33J | 0.30 | 1.0 | — | 360 |
| 23 | 540 | 0.2 | 1.0 | 207 | — |
| 24 | 2J | 0.2 | 1.0 | 192 | — |
| 25 | 7J | 0.2 | 1.0 | 233 | — |
| 26 | 21J | 0.2 | 1.0 | 218 | — |
| 27 | 33J | 0.2 | 1.0 | 182 | — |
| 28 | 40J | 0.2 | 1.0 | 207 | — |

EXAMPLE 3

DRAINAGE OF CHEMICAL PULP

In this example a series of tests was conducted using a bleached chemical pulp comprised of 70% hardwood and 30% softwood. A 0.3 wt. % stock was prepared and 1.5 g/l of sodium sulfate decahydrate was again added to provide a specific conductivity similar to that of a typical white water. Drainage tests were conducted using various amounts of Polyhall 650 anionic polyacrylamide, cationic sol and alum at both pH 4 and pH 8.

It may be seen from the results in Table 3 that at pH 4 the combination of the anionic polyacrylamide with the cationic sol is far more effective in increasing drainage (freeness) than the combination of the polyacrylamide with papermakers alum (of Tests 4–7 with Tests 8–13). At pH 8 the differences are not as large but higher freeness is still obtainable with the cationic sol. Tests 17–21 show that very high freeness can be obtained by using larger quantities of the anionic polyacrylamide and the cationic sol.

TABLE 3

DRAINAGE OF CHEMICAL PULP
(70% Hardwood, 30% Softwood)

| Test # | Wt. % Polyhall 650 Loading | Wt. % Cationic Sol Loading | Wt. % Alum Loading | Freeness, ml pH 4 | Freeness, ml pH 8 |
|---|---|---|---|---|---|
| 1 | — | — | — | 295 | 280 |
| 2 | 0.1 | — | — | 265 | 195 |
| 3 | 0.2 | — | — | 230 | 145 |
| 4 | 0.2 | — | 0.5 | 225 | 500 |
| 5 | 0.2 | — | 1.0 | 215 | 460 |

TABLE 3-continued

DRAINAGE OF CHEMICAL PULP
(70% Hardwood, 30% Softwood)

| Test # | Wt. % Polyhall 650 Loading | Wt. % Cationic Sol Loading | Wt. % Alum Loading | Freeness, ml pH 4 | Freeness, ml pH 8 |
|---|---|---|---|---|---|
| 6 | 0.2 | — | 2.0 | 212 | 405 |
| 7 | 0.2 | — | 5.0 | 215 | 365 |
| 8 | 0.2 | 0.25 | — | 495 | 460 |
| 9 | 0.2 | 0.5 | — | 530 | 560 |
| 10 | 0.2 | 0.5 | 1.0 | 440 | 530 |
| 11 | 0.2 | 0.6 | — | 540 | 550 |
| 12 | 0.2 | 0.75 | — | 535 | 565 |
| 13 | 0.2 | 1.0 | — | 547 | 540 |
| 14 | 0.1 | 0.5 | — | 460 | 460 |
| 15 | 0.05 | 0.5 | — | 375 | 370 |
| 16 | 0.025 | 0.5 | — | 325 | 335 |
| 17 | 0.4 | 0.5 | — | 600 | 565 |
| 18 | 0.6 | 0.5 | — | 540 | 563 |
| 19 | 0.8 | 0.5 | — | 610 | 565 |
| 20 | 1.0 | 0.5 | — | 610 | 560 |
| 21 | 1.0 | 1.0 | — | 700 | 650 |

EXAMPLE 4

DRAINAGE OF THERMOMECHANICAL PULP

In this example a 0.3 wt. % stock from a thermomechanical pulp of 100% Aspen origin was prepared. 1.5 g/l of sodium sulfate decahydrate was added to simulate electrolytes. The Canadian Standard Freeness Tests listed in Table 4 show that with this stock, improved drainage at both ph 4 and pH 8 was obtained using Polyhall 7J anionic polyacrylamide with cationic sol versus the use of the same polyacrylamide with alum.

TABLE 4

DRAINAGE OF THERMOMECHANICAL PULP
(100% Aspen)

| Test # | Wt. % Polyhall 7J Loading | Wt. % Cationic Sol Loading | Wt. % Alum Loading | Freeness, ml pH 4 | Freeness, ml pH 8 |
|---|---|---|---|---|---|
| 1 | — | — | — | 240 | 210 |
| 2 | 0.1 | — | — | 92 | 50 |
| 3 | 0.2 | — | — | 64 | 25 |
| 5 | 0.2 | — | 0.5 | 66 | 200 |
| 6 | 0.2 | — | 1.0 | 60 | 270 |
| 7 | 0.2 | — | 2.0 | 66 | 265 |
| 8 | 0.2 | 0.25 | — | 225 | 230 |
| 9 | 0.2 | 0.50 | — | 375 | 415 |
| 10 | 0.2 | 0.75 | — | 475 | 526 |
| 11 | 0.2 | 1.0 | — | 535 | 550 |
| 12 | 0.1 | 0.5 | 1.0 | 365 | 490 |

EXAMPLE 5

DRAINAGE/RETENTION OF CHEMICAL THERMOMECHANICAL PULP

In this example, the freeness of a chemical thermomechanical pulp was examined. In addition, to obtain a measure of fines retention, turbidity measurements were made on the white water drainage from the freeness tests. The furnish was of 0.3 wt. % consistency with 1.5 g/l sodium sulfate decahydrate as electrolyte. The combination of anionic polyacrylamide with cationic sol at pH 4 showed a greater response to both improved freeness and improved retention (lower turbidity) than did the polyacrylamide combined with alum. At pH 8, the freeness of both combinations remained at comparable values although the cationic sol system showed better retention. The results are given in Table 5.

TABLE 5

DRAINAGE/RETENTION OF CHEMICAL THERMOMECHANICAL PULP

| Test # | Wt. % Hyperfloc AF 302 Loading | Wt. % Cationic Sol Loading | Wt. % Alum Loading | pH 4 Freeness | pH 4 Turbidity | pH 8 Freeness | pH 8 Turbidity |
|---|---|---|---|---|---|---|---|
| 1 | 0.025 | — | — | 325 | 124 | | |
| 2 | 0.025 | — | 0.25 | 325 | 150 | | |
| 3 | 0.025 | — | 0.5 | 320 | 140 | | |
| 4 | 0.025 | — | 1.0 | 320 | 140 | | |
| 5 | 0.025 | 0.25 | — | 345 | 66 | | |
| 6 | 0.025 | 0.5 | — | 365 | 43 | | |
| 7 | 0.025 | 1.0 | — | 360 | 42 | | |
| 8 | 0.05 | — | — | 285 | 170 | 175 | 240 |
| 9 | 0.05 | — | 0.25 | 280 | 160 | 250 | 182 |
| 10 | 0.05 | — | 0.5 | 280 | 160 | 445 | 44 |
| 11 | 0.05 | — | 1.0 | 285 | 142 | 335 | 60 |
| 12 | 0.05 | 0.25 | — | 355 | 49 | 375 | 49 |
| 13 | 0.05 | 0.5 | — | 395 | 28 | 390 | 26 |
| 14 | 0.05 | 0.1 | — | 410 | 28 | 395 | 24 |

EXAMPLE 6

FINES RETENTION AND DRAINAGE OF FILLED PULP

For these tests a 0.5 wt. % filled pulp stock comprising 70% chemical pulp (70% hardwood, 30% softwood), 29% Klondyke clay and 1% calcium carbonate was prepared. 1.5 g/l sodium sulfate decahydrate was added as electrolyte.

Britt Jar Tests for fines retention were then conducted using various loadings of Polyhall 650 anionic polyacrylamide with either alum or cationic sol. A constant stirrer speed of 800 rpm was used and tests were made at both pH 4 and pH 8. Table 6 lists the results.

It may be seen that at Polyhall 650 anionic polyacrylamide loadings of 0.1 wt %, use of the cationic sol gives superior retentions to the use of reference alum at both pH 4 and pH 6 (cf Tests 9–12 with Tests 3–5). At higher Polyhall 650 loadings of 0.2 wt. % superiority of the cationic sol over alum is maintained at pH 4. At pH 8 the differences are no longer marked.

Also included in Table 6 are some freeness values for the same pulp system (diluted to 0.3 wt. % consistency) at additive loadings corresponding to high fines retention levels. A clear superiority in drainage for the use of cationic sol versus alum is demonstrated.

TABLE 6

FINES RETENTION AND DRAINAGE OF FILLED PULP

| Test # | Wt. % Polyhall 650 Loading | Wt. % Cationic Sol Loading | Wt. % Alum Loading | pH 4 | pH 8 |
|---|---|---|---|---|---|
| | | | | % Fines Retention | |
| 1 | 0.1 | — | — | 44.3 | 49.9 |
| 2 | 0.2 | — | — | 56.0 | 72.4 |

TABLE 6-continued

FINES RETENTION AND DRAINAGE OF FILLED PULP

| Test # | Wt. % Polyhall 650 Loading | Wt. % Cationic Sol Loading | Wt. % Alum Loading | pH 4 | pH 8 |
|---|---|---|---|---|---|
| 3 | 0.1 | — | 0.5 | 44.1 | 47.9 |
| 4 | 0.1 | — | 1.0 | 44.5 | 42.7 |
| 5 | 0.1 | — | 2.0 | 44.4 | 46.1 |
| 6 | 0.2 | — | 0.5 | 55.2 | 89.7 |
| 7 | 0.2 | — | 1.0 | 55.6 | 86.5 |
| 8 | 0.2 | — | 2.0 | 54.0 | 73.0 |
| 9 | 0.1 | 0.25 | — | 72.8 | 69.5 |
| 10 | 0.1 | 0.50 | — | 63.3 | 70.2 |
| 11 | 0.1 | 0.75 | — | 62.4 | 63.2 |
| 12 | 0.1 | 1.00 | — | 55.5 | 61.3 |
| 13 | 0.2 | 0.25 | — | 81.7 | 90.6 |
| 14 | 0.2 | 0.50 | — | 86.6 | 90.4 |
| 15 | 0.2 | 0.75 | — | 86.6 | 88.4 |
| 16 | 0.2 | 1.00 | — | 88.9 | 88.0 |
| | | | | Freeness, ml | |
| 17 | 0.2 | — | 1.0 | 265 | 330 |
| 18 | 0.2 | — | 2.0 | 260 | 310 |
| 19 | 0.2 | 0.25 | — | 475 | 450 |
| 20 | 0.2 | 0.50 | — | 475 | 485 |

EXAMPLE 7

ADDITIVE EFFECT OF CATIONIC SOL ON DRAINAGE AND RETENTION

In this example the benefits of adding both cationic sol and anionic polyacrylamide versus anionic polyacrylamide alone to a filled pulp system containing alum was demonstrated. Freeness and white water turbidity measurements were made on a stock similar to that described in Example 6. Two commercial anionic polyacrylamide retention aids were used. Table 7 shows a significant enhancement in both freeness and fines retention (lower white water turbidity) on adding cationic sol in addition to alum and polyacrylamide (cf Tests 7–10 with Test 4, and Tests 18–19 with Test 17).

TABLE 7

ADDITIVE EFFECT OF CATIONIC SOL ON DRAINAGE AND RETENTION
(Filled Chemical Pulp at pH 4.0)

| Test # | Wt. % Polymer Loading | Wt. % Alum Loading | Wt. % Cationic Sol Loading | Freeness ml | Turbidity N.T.A. Units |
|---|---|---|---|---|---|
| Using Reten 521 | | | | | |
| 1 | 0.05 | — | — | 290 | 90 |
| 2 | 0.05 | 0.25 | — | 290 | 97 |
| 3 | 0.05 | 0.5 | — | 295 | 95 |
| 4 | 0.05 | 1.0 | — | 295 | 92 |
| 5 | 0.05 | 1.5 | — | 295 | 93 |
| 6 | 0.05 | 2.0 | — | 295 | 93 |
| 7 | 0.05 | 1.0 | 0.125 | 410 | 39 |

TABLE 7-continued

ADDITIVE EFFECT OF CATIONIC SOL ON DRAINAGE AND RETENTION
(Filled Chemical Pulp at pH 4.0)

| Test # | Wt. % Polymer Loading | Wt. % Alum Loading | Wt. % Cationic Sol Loading | Freeness ml | Turbidity N.T.A. Units |
|---|---|---|---|---|---|
| 8 | 0.05 | 1.0 | 0.25 | 455 | 33 |
| 9 | 0.05 | 1.0 | 0.5 | 435 | 41 |
| 10 | 0.05 | 1.0 | 1.0 | 385 | 45 |
| Using Reten 523 | | | | | |
| 15 | 0.05 | — | — | 285 | 98 |
| 16 | 0.05 | 0.5 | — | 275 | 99 |
| 17 | 0.05 | 1.0 | — | 290 | 96 |
| 18 | 0.05 | 1.0 | 0.25 | 360 | 68 |
| 19 | 0.05 | 1.0 | 0.5 | 335 | 86 |
| 20 | 0.05 | 1.0 | 1.0 | 285 | 134 |

EXAMPLE 8

RESISTANCE OF FINES RETENTION TO TURBULENCE

The improved resistance of pulp fines flocs formed from the co-use of anionic polyacrylamide with cationic sol to the effects of machine shear forces was demonstrated by further Britt Jar Tests using a filled pulp system similar to that of Example 6, but with variations in the speed of the stirrer. Higher stirring speed corresponds to higher shear. The tests were conducted at both pH 4 and pH 8 at two loadings of Polyhall 650 anionic polyacrylamide but at constant loadings of either 1.0 wt. % alum or 0.5 wt. % cationic sol. The superior performance of cationic sol versus alum is clearly shown at pH 4 in Table 8.

TABLE 8

RESISTANCE OF FINES RETENTION TO TURBULENCE
Filled Chemical Pulp

| Test # | Wt. % Polyhall 650 Loading | Turbulence r.p.m. | % Fines Retention pH 4 Alum | pH 4 Cat. Sol | pH 8 Alum | pH 8 Cat. Sol |
|---|---|---|---|---|---|---|
| 1 | 0.1 | 600 | 89.4 | 90.5 | 94.9 | 95.1 |
| 2 | 0.1 | 800 | 43.7 | 70.9 | 56.2 | 67.8 |
| 3 | 0.1 | 1000 | 34.5 | 50.8 | 56.2 | |
| 4 | 0.2 | 600 | 82.1 | 98.3 | 97.8 | 99.2 |
| 5 | 0.2 | 800 | 56.3 | 87.1 | 87.0 | 90.4 |
| 6 | 0.2 | 1000 | 30.4 | 71.2 | 76.0 | 82.0 |

Constant alum loading of 1.0 wt. %
Constant cationic sol loading of 0.5 wt. %

Further tests were conducted to demonstrate the retention, under conditions of increased shear, of the present invention versus a commercial prior art system employing colloidal silica. In these tests, the stock used was a fine paper stock comprising 70% pulp (70% hardwood and 30% softwood), 29% clay and 1% calcium carbonate. The pH of the stock was adjusted to 4.5. In these tests, the loadings of the anionic polyacrylamide was selected at the equivalent of 3 lb/ton (0.15 wt. %) and the cationic sol at 12 lb/ton (0.6 wt. %). Britt Jar tests were conducted at different agitation speeds to simulate different magnitudes of shear. The order of addition of the cationic and anionic components were reversed in certain of the tests to illustrate the effect of order of component addition. The results of these tests are given in Table 9. Further tests were conducted in like manner except that 100 ppm of lignin sulfonate, a representative anionic impurity, was added to the stock. The Table 10 shows the results of these tests and shows the superiority of the present invention. The "prior art" referred to in Tables 9 and 10 comprised anionic colloidal silica sol plus cationic starch marketed under the tradename Compozil by Procomp of Marietta, Ga.. The loadings employed in all tests were of 8 lb/ton (0.4 wt. %) of anionic colloidal silica plus 20 lb/ton (1.0 wt. %) of cationic starch. The loadings stated for each system had been established as giving nearly optimum values in fines retention for that system.

TABLE 9

RESISTANCE TO SHEAR FORCES

| Component Added First | Turbulence r.p.m. | % Fines Retention Polyhall 2J/ Cationic Sol | Polyhall 7J/ Cationic Sol | Prior-Art |
|---|---|---|---|---|
| Cationic | 600 | 90 | 73 | 87 |
| Cationic | 800 | 87 | 75 | 69 |
| Cationic | 1000 | 85 | 74 | 54 |
| Anionic | 600 | 99 | 95 | 93 |
| Anionic | 800 | 100 | 80 | 61 |
| Anionic | 1000 | 96 | 65 | 51 |

TABLE 10

RESISTANCE TO SHEAR FORCES

| Component Added First | Turbulence r.p.m. | % Fines Retention Polyhall 2J/ Cationic Sol | Polyhall 7J/ Cationic Sol | Prior Art |
|---|---|---|---|---|
| Cationic | 600 | 96 | 90 | 57 |
| Cationic | 800 | 94 | 85 | 38 |
| Cationic | 1000 | 85 | 84 | 36 |
| Anionic | 600 | 87 | 80 | 72 |
| Anionic | 800 | 81 | 70 | 43 |
| Anionic | 1000 | 52 | 58 | 38 |

What is claimed is:

1. In a papermaking stock including cellulose fibers in a concentration of at least about 50% by weight of such fibers in an aqueous medium the improvement comprising:

a cationic component comprising a colloidal silica sol compound selected from the group consisting of colloidal silicic acid sol, colloidal silicic acid sol modified with at least one surface layer of aluminum atoms, an anionic component selected from the group consisting of polyacrylamide prepared by the hydrolysis of polyacrylamide, polyacrylamide prepared by the copolymerization of acrylic acid with acrylamide, and polyacrylamide derived from the copolymerization of acrylamide with methacrylamide, said cationic component being present in the stock in a concentration between about 0.01 to about 2.0 weight percent based on the solids content of the stock, said anionic component being present in said stock at a concentration from about 0.01 to about 1.0 weight percent based on the solids content of the stock, whereby said stock is rendered effectively resistant to destruction of its retention and dewatering properties by shear forces incurred by said stock in the course of forming of the stock into a paper web.

2. The papermaking stock of claim 1 wherein said cationic component and said anionic components are present in a ratio of between about 1:100 and 100:1.

3. The papermaking stock of claim 2 wherein said cationic component and said anionic components are present in a ratio of between about 1:10 and 10:1.

4. The papermaking stock of claim 1 wherein the pH of said stock is between about 4 and about 9.

5. The papermaking stock of claim 1 wherein said anionic component exhibits an anionicity of between about 1 and about 40 percent.

6. The papermaking stock of claim 5 wherein said anionic component exhibits are anionicity of less than about 10 percent.

7. The papermaking stock of claim 1 wherein said anionic component has a molecular weight in excess of between about 100,000 and about 15,000,000.

8. The papermaking stock of claim 7 wherein said anionic component has a molecular weight between about 5,000,000 and 15,000,000.

9. The papermaking stock of claim 1 wherein said cationic component has a particle size of between about 3 and 30 nanometers.

10. A papermaking process employing a stock comprising at least about 50% by weight of cellulose fibers in an aqueous medium having a pH between about 3 and about 9, introduced from a headbox containing said stock onto a moving papermaking wire and vacuum felted thereon including the steps of:

introducing to said stock prior to its removal from said headbox onto said wire, a cationic colloidal silica sol component, separately introducing to said furnish prior to its removal from said headbox onto said wire an anionic polyacrylamide component, said cationic and said anionic components being present in a ratio of between about 1:10 and 10:1 based on weight and each component representing between about 0.01 and 1.0 weight percent of said stock based on total solids of said stock, and providing a time lapse between said introductions of said components sufficient to permit good mixing of said components with said stock.

* * * * *

UNITED STATES PATENT AND TRADEMARK OFFICE

CERTIFICATE OF CORRECTION

PATENT NO. : 4,798,653

DATED : January 17, 1989

INVENTOR(S) : John D. Rushmere

It is certified that error appears in the above-identified patent and that said Letters Patent is hereby corrected as shown below:

Title page:

In the name of the Assignee, after Procomp, delete -- , Inc. --

Column 2, line 1, change "as" to -- at --.

Column 9, line 37, "pH 6" should be -- pH 8 --.

Table 6, column 9, "% Fines Retention" should be moved up.

In the Claims:

Claim 6, second line, change "are" to -- an --.

Claim 7, second line, delete -- in excess --.

Signed and Sealed this

Twenty-second Day of August, 1989

*Attest:*

DONALD J. QUIGG

*Attesting Officer*

*Commissioner of Patents and Trademarks*